United States Patent [19]

Smith

[11] Patent Number: 4,576,494

[45] Date of Patent: Mar. 18, 1986

[54] PRINT WHEEL CARTRIDGE

[75] Inventor: Henry E. Smith, Pleasanton, Calif.

[73] Assignee: Xerox Corporation, Stamford, Conn.

[21] Appl. No.: 726,916

[22] Filed: Apr. 24, 1985

Related U.S. Application Data

[63] Continuation of Ser. No. 559,540, Dec. 8, 1983, abandoned.

[51] Int. Cl.[4] ..... B41J 1/04

[52] U.S. Cl. ..... 400/175; 400/144.2

[58] Field of Search ..... 400/144.2, 144.3, 175; 242/198

[56] References Cited

U.S. PATENT DOCUMENTS

| | | | |
|---|---|---|---|
| 2,943,805 | 7/1960 | Loewe | 242/198 |
| 3,059,871 | 10/1962 | Loewe | 242/198 |
| 4,022,401 | 5/1977 | Kishi | 242/198 |
| 4,234,262 | 11/1980 | Nakai et al. | 400/175 |
| 4,310,255 | 1/1982 | Asano et al. | 400/175 X |
| 4,332,490 | 6/1982 | Tschudi | 400/175 |
| 4,370,071 | 1/1983 | Habich et al. | 400/144.2 |
| 4,475,827 | 10/1984 | Willemse | 400/144.2 |

FOREIGN PATENT DOCUMENTS

| | | | |
|---|---|---|---|
| 0048311 | 3/1982 | European Pat. Off. | 400/175 |
| 946106 | 5/1949 | France | 242/198 |
| 144967 | 11/1981 | Japan . | |
| 2022022 | 12/1979 | United Kingdom | 400/175 |

*Primary Examiner*—Edgar S. Burb
*Assistant Examiner*—Charles A. Pearson
*Attorney, Agent, or Firm*—Serge Abend; Richard A. Tomlin

[57] ABSTRACT

A print wheel cartridge for a serial printer. The cartridge includes a spring designed to lock the print wheel in the cartridge. The spring automatically releases the print wheel when the cartridge is inserted into the printer.

1 Claim, 7 Drawing Figures

PRINT WHEEL CARTRIDGE

This is a continuation of application Ser. No. 559,540 filed Dec. 8, 1983, now abandoned.

The invention relates to a print wheel cartridge for serial printing.

The use of print wheel cartridges for containing print wheels is well known. The cartridge acts as a vehicle for the insertion and removal of the print wheel from the printer. It acts to protect the print wheel from damage during handling and reduces the necessity for the operator to handle print wheels which may have ink on them.

The present invention is directed to a print wheel cartridge which is relatively inexpensive to produce, which contains spring means for positively locking the print wheel in place in the cartridge, the spring means also being adapted to automatically release the print wheel for rotation upon insertion of the cartridge into the printer. The cartridge also has abutment means for assisting in the insertion and removal of the print wheel.

An embodiment of the print wheel cartridge of this invention is described in detail below with reference to the drawing, which illustrates only one specific embodiment in which.

Figure 1A:
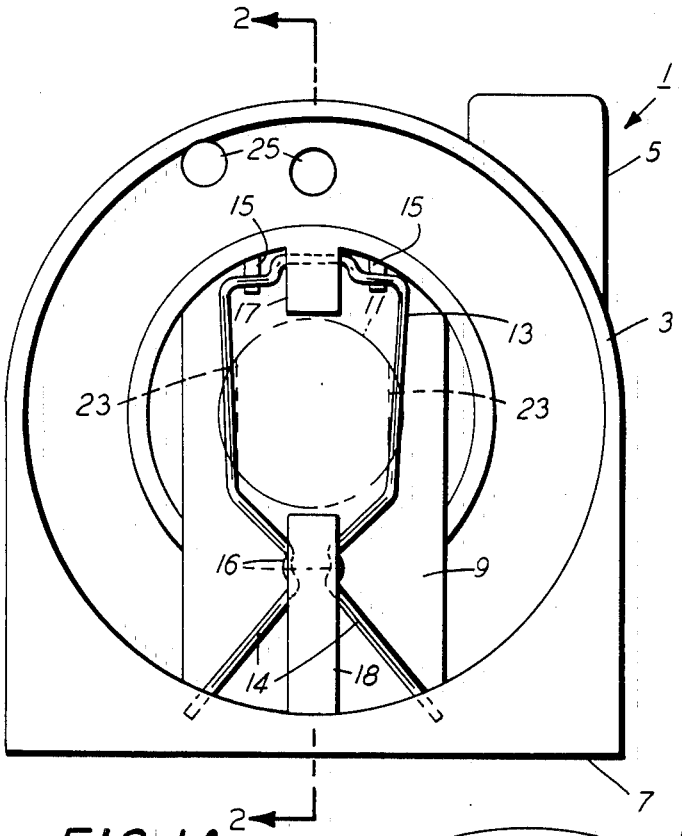
FIG. 1A is a front planar view of a print wheel cartridge of this invention showing the spring means in the print wheel lock position.
Figure 2:
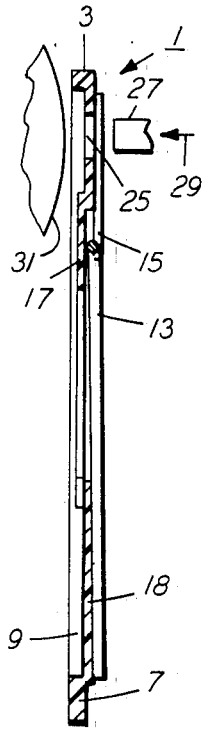
FIG. 2 is a side sectional view of the print wheel cartridge of FIG. 1 taken along line 2—2.
Figure 1B:
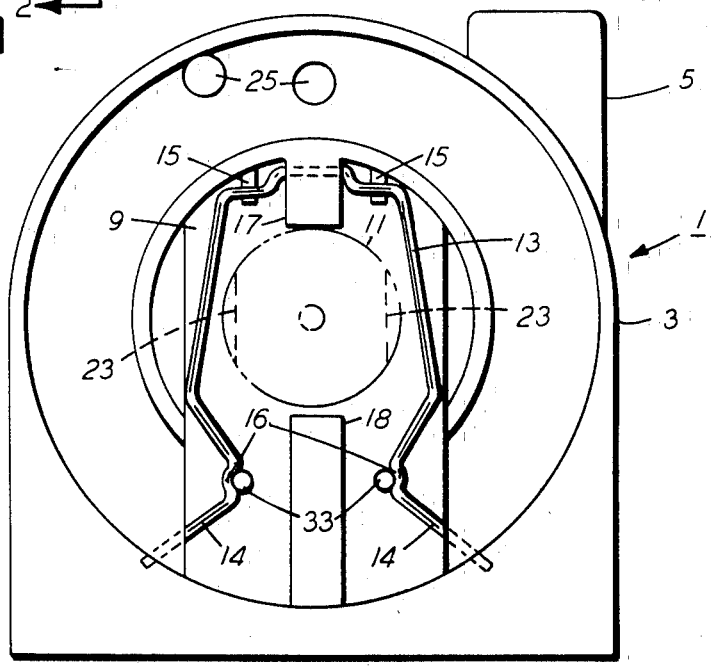
FIG. 1B is a front planar view of a print wheel cartridge in accordance with this invention showing the spring means in the print wheel release position.

Referring now to FIGS. 1A, 1B and 2, there is shown a print wheel cartridge generally designated 1 as seen from the printer platen side, which comprises a body 3 having a projection 5 for the operator to hold the print wheel cartridge 1, and a bottom alignment edge 7 for aligning the print wheel cartridge 1 in the printer (not shown). Print wheel cartridge body 3 is provided with an opening 9 for receipt of print wheel hub 11 (shown in broken line) and print wheel retention spring 13. Print wheel retention spring 13 is held in place in print wheel cartridge body 3 by press fit in tabs 15 and by contact with abutment tab 17 and by extending beyond the opening 9 towards the alignment edge 7. Only the hub of the print wheel is represented in FIGS. 1A and 1B in order to more clearly show the structure of print wheel cartridge 1. Print wheel hub 11 is provided with flat sides 23 against which print wheel retention spring 13 acts. The flat sides 23 of print wheel hub 11 provide an initial rotational orientation when the print wheel hub 11 is placed in the print wheel cartridge 1. Print wheel retention spring 13 is biased to close toward the center of print wheel hub 11 so that when print wheel hub 11 is assembled in print wheel cartridge 1, the print wheel hub 11, and thus the print wheel, is locked in place by retention spring 13. Print wheel cartridge body 3 is further provided with one or more apertures 25 through which print hammer or hammers 27 (see FIG. 2) are directed in the print direction indicated by arrow 29 towards the print wheel (not shown), type ribbon and paper (not shown) and printer platen 31 in the conventional manner.

When it is desired to insert the print wheel into the printer, the operator holds print wheel cartridge 1 by projection 5 and pushes it into the printer. As the print wheel cartridge 1 is pushed in to the printer, the print wheel hub 11 is held in place by print wheel retention spring 13 and abutment tab 17. Also, as print wheel cartridge 1 is forced into the printer, guide arm portions 14 of retention spring 13 come into contact with pins 33 (see FIG. 1B). Retention spring 13 and pins 33 are designed such that when alignment edge 7 is aligned in the printer carriage (not shown), pins 33 have forced retention spring 13 open far enough to release print wheel hub 11 for rotation by print wheel drive means 65 (see FIG. 6). Spring retention means 13 is also provided with curved detents 16 for holding spring retention means 13 on pins 33.

Figure 3:
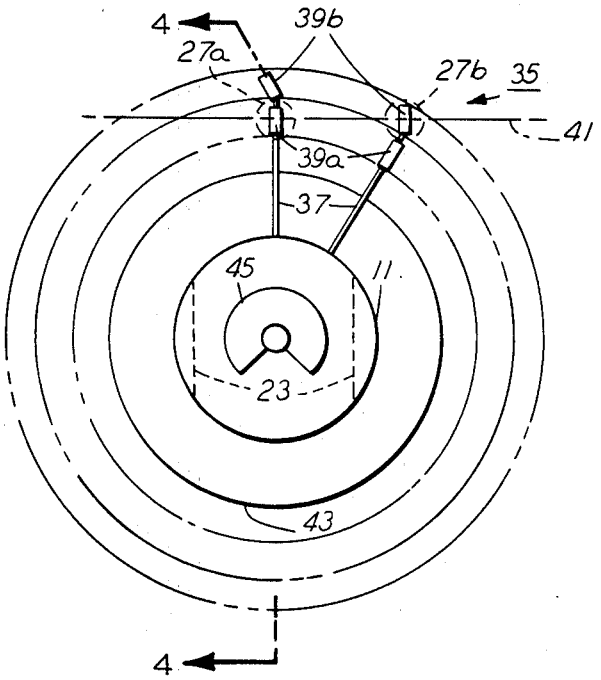
FIG. 3 is a planar back view of a print wheel for use with the print wheel cartridge of this invention.
Figure 4:
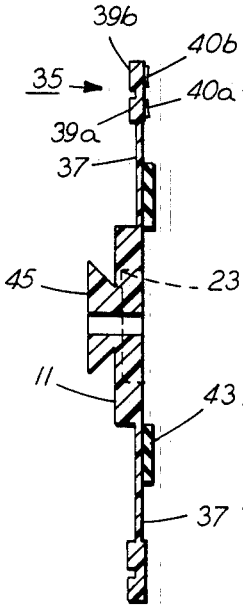
FIG. 4 is a side sectional view of the print wheel cartridge of FIG. 3 taken along line 4—4.

Referring now to FIGS. 3 and 4, there is shown a print wheel, generally designated 35, viewed from the printer print hammer 27 side, which print wheel 35 comprises a print wheel hub 11 and extending therefrom a plurality of radially extending beams 37. Only two beams 37 are shown here. The print wheel 35 would actually contain 80 to 100 or more beams 37. Formed on beams 37 are inboard character bearing pads **39*a* and outboard character bearing pads 39*b*. The dashed circles 27 represent print hammer locations. An explanation of the operation of a dual hammer print wheel system is disclosed in U.S. Pat. No. 4,069,907, issued Jan. 24, 1978. In general, one hammer 27*a* is used for the inboard character bearing pads 39a, and one hammer 27*b* is used for the outboard character bearing pads 39*b*, but in either case printing occurs along line of printing 41. Print wheel beams 37 are supported by rubber ring 43. Print wheel hub 11 has a tapered locking section 45 formed thereon for attaching to the print wheel drive means 65 (see FIG. 6) by print wheel connecting means shown generally as 47 (see FIG. 5). As shown in FIG. 4, the character fonts 40*a* and 40*b* on character bearing pads 39*a* and 39*b***, respectively, face to the right.

Figure 5:
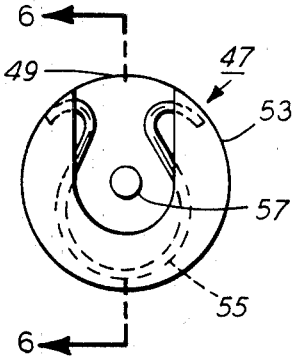
FIG. 5 is a front view of a print wheel drive connector for use with the print wheel cartridge of this invention.
Figure 6:
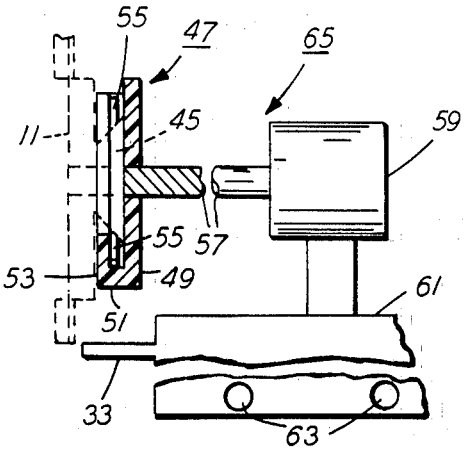
FIG. 6 is a side sectional view of the print wheel drive connector of FIG. 5 taken along line 6—6 and a print wheel drive and carriage mechanism.

Referring now to FIGS. 5 and 6, there is shown a print wheel drive connector 47, which has a disc-shaped base 49, a sidewall 51 and a slotted disc top 53. Retained within base 49, sidewall 51 and slotted disc top 53 is connector spring 55. Connector spring 55 is sized such that when print wheel tapered locking section 45 is pressed into the drive connector 47, connector spring 55 allows passage of tapered locking section 45. Connector spring 55 is biased to squeeze tapered locking section 45, thus wedging tapered locking section 45 against connector drive means 47 as shown in FIG. 6. Drive connector 47 is mounted on drive shaft 57 which is driven by motor 59. Motor 59 is mounted on printer print wheel carriage 61. Print wheel carriage 61 is mounted on guide rods 63 for sliding movement parallel to platen 31 (see FIG. 2) and thus line of printing 41 (see FIG. 3). Means for moving carriage 61 reciprocally parallel to platen 31 and line of printing 41 are not shown but are well known in the art. Carriage 61 is provided with two projecting pins 33 which are positioned such that when print wheel cartridge 1 is pushed down into print wheel drive connector 47, pins 33 force print wheel retention spring 13 open, freeing print wheel 35 for rotation by print wheel drive means, shown generally as 65, and includes print wheel drive connector 47, drive shaft 57 and motor 59. Abutment tab 17 prevents the print wheel 35 from slipping out of print wheel retention spring 13 as the print wheel cartridge 1 is being pressed into print wheel drive connector 47. To remove the print wheel 35 from the printer, the operator holds the cartridge by projection 5 and pulls upward. Print wheel cartridge abutment tab 18 "picks up" print wheel hub 11. As print wheel cartridge 1 is raised further, retention spring 13 is withdrawn from contact with pins 33 allowing retention spring 13 to close on print wheel hub 11 thus locking print wheel 35 in place in print wheel cartridge 1.

It can be seen that the print wheel cartridge 1 of this invention provides a convenient, inexpensive mechanism for print wheel handling and for insertion into and extraction from a printer.

While the principles of the invention have been made clear in the illustrative embodiment, there will be many modifications in structure, arrangement, proportions etc., which will occur to those skilled in the art. For example, although this invention was described in connection with two character rows and two print hammers, obviously the cartridge could be used in conventional single character row, single print hammer printers. The appended claims are, therefore, intended to cover and embrace any such modifications within the scope and spirit of the invention.

What is claimed is:

1. A printwheel cartridge for use in a printer having a carriage including printwheel release means thereon, said cartridge comprising:

a printwheel having a hub, and a pair of substantially parallel flat portions on said hub, said printwheel being housed within said cartridge for protection during handling and for being rotationally oriented for usage, a pair of opposed abutment means each having a driving face for acting on said hub, one abutment means drives said printwheel in one direction insertion and the other abutment means drives said printwheel in a direction opposite to said one direction during removal of said cartridge from said carriage, the distance between the driving faces of said abutment means being slightly greater than the diameter of said hub for allowing free rotation of said printwheel within said cartridge during operation of said printer, and spring retaining means having a pair of arms biased radially toward said printwheel hub for engaging said flat portions to prevent rotation of said printwheel, said arms extending substantially parallel to said one direction for allowing said cartridge to slide relative to said printwheel in order that the driving faces of said abutment means may engage said hub, and each of said spring arms includes detent means for receiving said printwheel release means for moving said arms away from said hub to free said printwheel for rotation within said cartridge.

* * * * *